US010072655B2

(12) United States Patent
Lundberg et al.

(10) Patent No.: US 10,072,655 B2
(45) Date of Patent: Sep. 11, 2018

(54) COMPRESSOR HAVING A PRESSURIZED CASE

(71) Applicants: Bosch Automotive Service Solutions LLC, Warren, MI (US); Robert Bosch GmbH, Stuttgart (DE)

(72) Inventors: Dylan M. Lundberg, Lonsdale, MN (US); Mark W. McMasters, Owatonna, MN (US)

(73) Assignees: Bosch Automotive Service Solutions LLC, Warren, MI (US); Robert Bosch GmbH, Stuttgart (DE)

( * ) Notice: Subject to any disclaimer, the term of this patent is extended or adjusted under 35 U.S.C. 154(b) by 557 days.

(21) Appl. No.: 14/567,038

(22) Filed: Dec. 11, 2014

(65) Prior Publication Data

US 2015/0184644 A1 Jul. 2, 2015

Related U.S. Application Data

(60) Provisional application No. 61/922,184, filed on Dec. 31, 2013.

(51) Int. Cl.

| | |
|---|---|
| ***F04B 53/16*** | (2006.01) |
| ***F04B 39/12*** | (2006.01) |
| ***F25B 31/02*** | (2006.01) |
| ***F25B 49/02*** | (2006.01) |
| ***F25B 45/00*** | (2006.01) |
| *F25B 1/02* | (2006.01) |

(52) U.S. Cl.

CPC ..... *F04B 53/16* (2013.01); *F04B 39/121* (2013.01); *F04B 39/123* (2013.01); *F25B 31/023* (2013.01); *F25B 45/00* (2013.01); *F25B 49/022* (2013.01); *F25B 1/02* (2013.01); *F25B 2345/0051* (2013.01); *F25B 2500/18* (2013.01); *F25B 2500/221* (2013.01); *F25B 2600/027* (2013.01); *F25B 2600/2515* (2013.01); *F25B 2600/2519* (2013.01); *F25B 2700/193* (2013.01)

(58) Field of Classification Search

None

See application file for complete search history.

(56) References Cited

U.S. PATENT DOCUMENTS 4,688,997 A * 8/1987 Suzuki ..... F04B 27/1036 417/222.2

2006/0037336 A1 2/2006 Bush (Continued)

OTHER PUBLICATIONS

European Search Report and Written Opinion for corresponding European Patent Application 14199776.7, dated Jun. 18, 2015 (6 pages).

*Primary Examiner* — Kenneth J Hansen

(74) *Attorney, Agent, or Firm* — Maginot Moore & Beck LLP

(57) ABSTRACT

A compressor system for an air conditioning service system includes a compressor having a compressor case and a compressor head, an inlet, an outlet, a low side passage fluidly connecting the inlet to the compressor head, and a high side passage fluidly connecting the outlet to the compressor head. A low side return passage fluidly connects the compressor case with the low side passage and a first valve is positioned at least partially in the low side return passage and configured to control flow in the low side return passage.

8 Claims, 7 Drawing Sheets

(56) References Cited

U.S. PATENT DOCUMENTS

| | | | | |
|---|---|---|---|---|
| 2007/0160482 | A1* | 7/2007 | Inoue | F04B 41/06 417/206 |
| 2009/0308086 | A1 | 12/2009 | Lifson et al. | |
| 2012/0192579 | A1* | 8/2012 | Huff | B60H 1/3232 62/115 |
| 2013/0008192 | A1 | 1/2013 | McMasters et al. | |
| 2014/0182312 | A1 | 7/2014 | Lundberg et al. | |

* cited by examiner

COMPRESSOR HAVING A PRESSURIZED CASE

CLAIM OF PRIORITY

This application claims the benefit of priority to co-pending U.S. provisional application No. 61/922,184, entitled "Compressor Having a Pressurized Case," which was filed on Dec. 31, 2013, the disclosure of which is incorporated herein by reference in its entirety.

TECHNICAL FIELD

This disclosure relates generally to compressors, and more particularly to compressors for air conditioning service systems.

BACKGROUND

Air conditioning systems are currently commonplace in homes, office buildings and a variety of vehicles. Over time, the refrigerant included in these systems becomes depleted and/or contaminated. As such, in order to maintain the overall efficiency and efficacy of an air conditioning system, the refrigerant included therein is periodically replaced or recharged.

Refrigerant recovery units are used in connection with maintaining and servicing refrigeration circuits. The portable machines include hoses coupled to the refrigeration circuit to be serviced. A compressor operates to recover refrigerant from the air conditioning system, flush the refrigerant, and subsequently recharge the system from a supply of either recovered refrigerant and/or new refrigerant from a refrigerant tank.

Due to the nature of portable refrigerant recovery units, the pistons within the unit compressors of the recovery unit do not form a perfect seal with the cylinder side wall. For this reason, compressed refrigerant leaks through the piston rings into the compressor case. In some compressors, the compressor case is open to atmosphere, and any refrigerant leaking into the case is lost. After significant use, the piston rings can become worn or damaged leading to an increased rate of leakage, and the lost refrigerant can become a substantial amount. This can lead to increased cost of recovery to replace the lost refrigerant.

In some compressors, the compressor case is sealed, and includes a passage between the compressor case and the inlet of the compressor, called a "bleedback hole," to allow refrigerant within the case to escape back to the inlet. The bleedback hole also allows pressure from the low-side inlet to freely enter the crank case. Pressure in the crank case increases the efficiency of the compressor, since the pressure acts on the pistons of the compressor to assist in the compression stroke of the piston. However, the efficiency increase due to only low-side pressure entering the crank case is minimal. Once running, this small amount of pressure within the crank case becomes negligible as the source tank or system supplying the pressurized refrigerant depletes.

Furthermore, systems having a bleedback hole do not allow control or selection of the pressure in the crank case. The bleedback hole is perpetually bleeding pressure between the compressor inlet and the crank case. This also makes it difficult for the compressor to produce a vacuum on the air conditioning system being serviced at the end of the recovery operation, as a certain amount of refrigerant will continue to flow through the bleedback hole.

What is needed, therefore, is an improved compressor for a refrigerant recovery unit having increased efficiency and reduced refrigerant losses.

SUMMARY

In one embodiment, a compressor system for an air conditioning service system includes a compressor having a compressor case and a compressor head, an inlet, an outlet, a low side passage fluidly connecting the inlet to the compressor head, and a high side passage fluidly connecting the outlet to the compressor head. A low side return passage fluidly connects the compressor case with the low side passage and a first valve is positioned at least partially in the low side return passage and configured to control flow in the low side return passage.

In another embodiment, the compressor is configured such that a portion of fluid compressed by the compressor moves from the compressor head to the compressor case. The first valve is a check valve configured to prevent flow through the low side return passage from the low side passage to the compressor case, and the first valve is configured to open at a predetermined pressure difference between the compressor case and the low side passage to connect the compressor case to the low side passage.

In another embodiment, the predetermined pressure difference at which the check valve opens is approximately 300 psi.

In a further embodiment, the compressor system further comprises a high side return passage fluidly connecting the compressor case with the high side passage. The first valve includes a high side portion and a low side portion, and the low side portion is positioned in the low side return passage and is configured to control flow through the low side return passage and the high side portion is positioned in the high side return passage and is configured to control flow through the high side return passage.

In some embodiments, the first valve is configured such that the high side portion opens to connect the compressor case to the high side passage when a first pressure in the compressor case is less than or equal to a first predetermined threshold and the first valve is configured such that the high side portion closes to disconnect the compressor case from the high side passage when the first pressure is greater than the first predetermined threshold.

In another embodiment, the first valve is configured such that the low side portion closes to disconnect the compressor case from the low side passage when a second pressure in the low side passage is greater than a second predetermined threshold and the first valve is configured such that the low side portion opens to connect the compressor case to the low side passage when the second pressure is less than or equal to the second predetermined threshold.

In yet another embodiment, the compressor system includes a first pressure sensor configured to generate a first pressure signal corresponding to a first pressure in the low side passage, a second pressure sensor configured to generate a second pressure signal corresponding to a second pressure in the compressor case; and a controller. The controller is configured to obtain a first pressure signal from the first pressure sensor and the second pressure signal from the second sensor and to operate the first valve to open and close based upon a pressure difference between the first pressure signal and the second pressure signal.

In a further embodiment, the controller is configured to operate the first valve to open upon initiation of a recovery operation, to close upon the first and second pressure signals being equal, and to open upon the first pressure signal being equal to or less than a predetermined threshold.

In some embodiments, the compressor system further comprises a high side return passage fluidly connecting the compressor case with the high side passage and a second valve positioned in the high side return passage and configured to control flow through the high side return passage. The controller is further configured to open the second valve during operation of the compressor to connect the high side passage to the compressor head and to close the second valve upon the first pressure signal being greater than a case pressure threshold.

In one embodiment according to the disclosure, a method of operating a compressor system for an air conditioning service system comprises moving pressurized fluid into a compressor case, operating a compressor head to move fluid between a low side passage and a high side passage, and moving fluid from the compressor case through a first valve located in a low side return passage to the low side passage after operation of the compressor.

In another embodiment, the moving of the pressurized fluid into the compressor case includes moving the fluid from the compressor head to the compressor case during the operation of the compressor head and the moving of fluid from the compressor case includes opening the first valve in response to a pressure difference between the compressor head and the low side passage exceeding a predetermined pressure difference.

In a further embodiment, the opening of the first valve includes opening the first valve in response to the pressure difference between the compressor head and the low side passage exceeding 300 psi.

In one embodiment, the method further comprises opening a high side portion of the first valve positioned in a high side return passage to connect a high side passage to the compressor case when a first pressure in the compressor case is less than or equal to a first predetermined threshold and closing the high side portion of the first valve to disconnect the high side passage from the compressor case when the first pressure is greater than the first predetermined threshold.

In another embodiment, the method further includes closing a low side portion of the first valve positioned in the low side return passage to disconnect the compressor case from the low side passage when a second pressure in the low side passage is greater than a second predetermined threshold and closing the low side portion of the first valve to disconnect the compressor case from the low side passage when the second pressure is greater than the first predetermined threshold.

In yet another embodiment, the method further comprises sensing a first pressure in the low side passage, sensing a second pressure in the compressor case, and operating the first valve to open and close based upon a pressure difference between the first pressure signal and the second pressure signal.

In a further embodiment, the method includes operating the first valve to open upon initiation of a recovery operation, operating the first valve to close upon the first and second pressures being equal, and operating the first valve to open upon the first pressure being equal to or less than a predetermined threshold.

In another embodiment, the method further comprises operating a second valve positioned in a high side return passage between the compressor case and a high side passage to connect the high side passage to the compressor head during the operation of the compressor and operating the second valve to close upon the first pressure being greater than a case pressure threshold.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
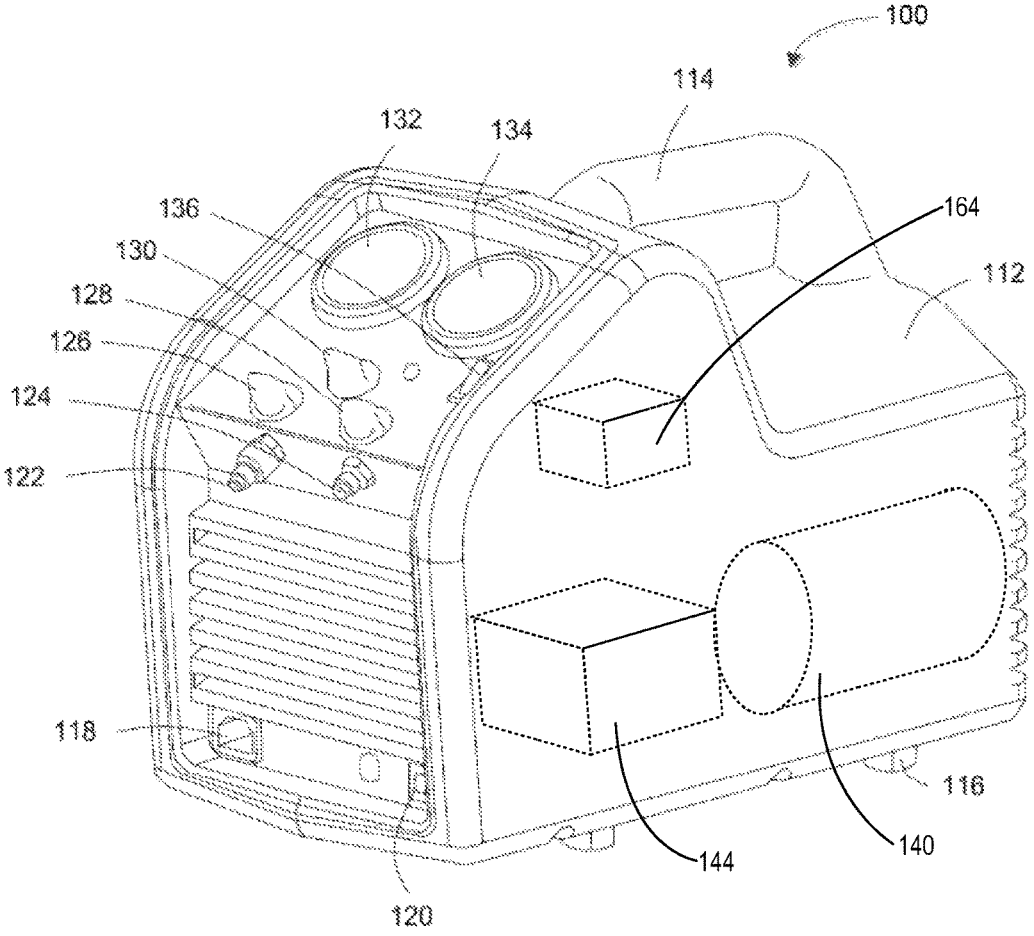
FIG. 1 is a side perspective view of a refrigerant recovery unit showing the compressor within the refrigerant recovery unit.

A perspective view illustrating an exemplary portable refrigerant recovery unit 100 is depicted in FIG. 1. The refrigerant recovery unit 100 includes an enclosure 112 that may be made from molded plastic and the like. The enclosure 112 is configured to enclose the major components of the refrigerant recovery unit 100 as discussed herein. The portable refrigerant recovery unit 100 includes a handle 114 for a user to move the refrigerant recovery unit 100 from one place to another. The handle 114 can be made from the same material as the enclosure 112 or from an elastomeric material for more comfort to the user. Feet 116 are positioned on a bottom portion of the enclosure 112 in order to keep the refrigerant recovery unit 100 from touching the ground.

A power connection 118 provides power to the refrigerant recovery unit 100 when plugged into a power source (not shown). A circuit breaker 120 protects the refrigerant recovery unit 100 from any surge in the power source. In one embodiment, the circuit breaker 120 and power connection 118 are provided on a front portion of the refrigerant recovery unit 100.

The front portion of the refrigerant recovery unit 100 also includes an inlet fitting 122 and an outlet fitting 124. The inlet fitting 122 is configured to receive refrigerant from a refrigerant containing system (not shown), such as an air conditioning system, and the outlet fitting 124 is configured to send the recovered refrigerant to the refrigerant containing system (not shown). In some embodiments, the inlet fitting 122 includes a replaceable filter (not shown) to remove any contaminants that may be in the recovered refrigerant of the refrigerant containing system (not shown). A control knob 126 is configured to control the functionality of the inlet fitting 122 and a control knob 128 is configured to control the functionality of the outlet fitting 124. A self purge knob 130 is provided to purge contaminants or remaining refrigerant from the refrigerant containing system. High side and low side pressure gauges 132 and 134 are positioned on a top surface to show the respective pressures. A power button 136 is located on the top surface to turn on and off the refrigerant recovery unit 100.

The refrigerant recovery unit 100 also includes a compressor 140 and a manifold block 144 fixed within the enclosure. The compressor 140 and manifold block 144 are operatively connected to one another and to the inlet and outlet fittings 122, 124.

The refrigerant recovery unit 100 further includes an electronic controller 164 located within the enclosure 112. Operation and control of the various components, including solenoid valves (not shown) and the compressor 140, and functions of the refrigerant recovery unit 100 are performed with the aid of the controller 164. The controller 164 is implemented with general or specialized programmable processors that execute programmed instructions. The instructions and data required to perform the programmed functions are stored in a memory unit associated with the controller 164. The processors, memory, and interface circuitry configure the controller 164 to perform the functions described above and the processes described below. These components are provided on a printed circuit board or as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The electronic controller 164 receives data signals or communication from sensors, including pressure and temperature sensors, control switches, such as the control knobs 126 and 128, self purge knob 130, and power button 136.

Figure 2C:
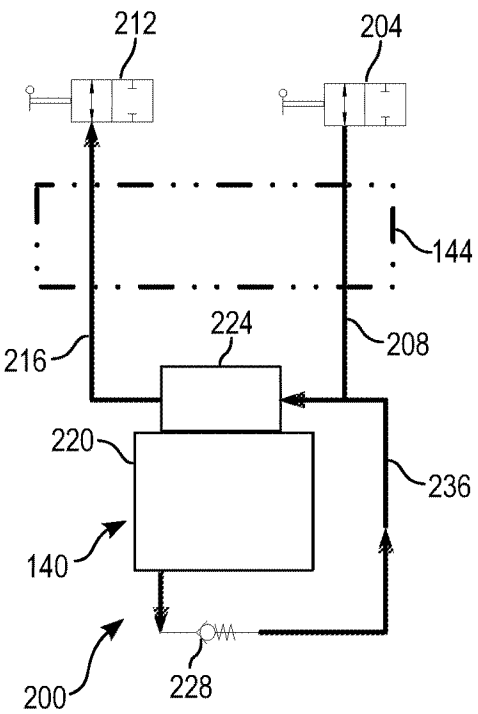
FIG. 2C is a schematic diagram of the compressor of FIG. 2A when the pressure in the compressor case is exceeds the valve threshold and opens the valve.
Figure 2B:
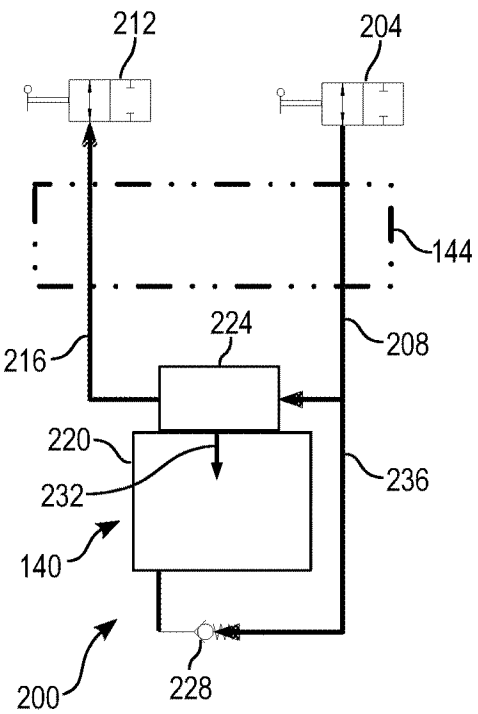
FIG. 2B is a schematic diagram of the compressor of FIG. 2A when the pressure in the compressor case is below the valve threshold.
Figure 2A:
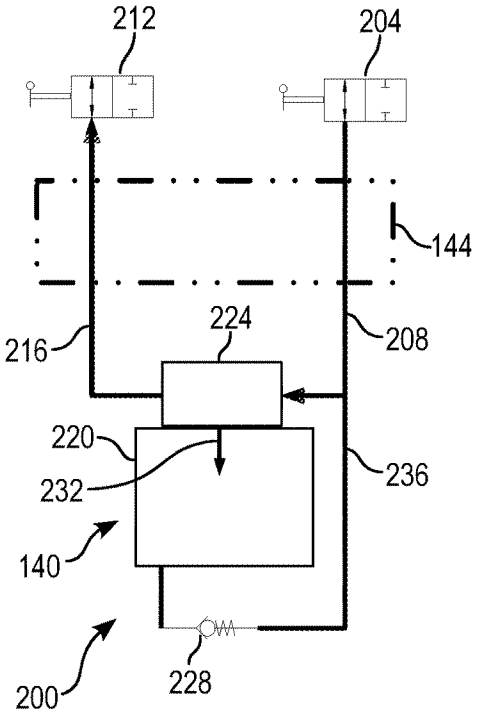
FIG. 2A is a schematic diagram of a compressor having a valve configured to control pressure in the compressor case, depicted at the beginning of a recovery operation.

FIGS. 2A-2C illustrate a simplified schematic view of one embodiment of a compressor system 200 for the refrigerant recovery system 100 discussed above with reference to FIG. 1. The compressor system 200 includes the compressor 140, a low-side inlet valve 204, a low-side inlet passage 208, a high-side outlet valve 212, a high-side outlet passage 216, and a check valve 228 positioned in a return passage 236. The inlet valve 204 is configured to regulate flow coming into the compressor 140. In one embodiment, the inlet valve is connected to the inlet fitting 122 (FIG. 1), while in other embodiments the inlet valve is fluidly connected to a refrigerant storage tank. The low-side inlet passage 208 connects the low-side inlet valve 204, through the manifold block 144, to the compressor 140. The high pressure side of the compressor is connected through the manifold 144 to the high-side outlet valve 212 by a high-side outlet passage 216. The outlet valve 212 is connected to the outlet fitting 124 (FIG. 1) or to a refrigerant storage tank.

The compressor 140 includes a compressor case 220 and a compressor head 224. The compressor case 220 is sealed from atmosphere to prevent egress of gas inside the compressor case 220. The compressor head 224 includes one or more compressor pistons (not shown), which are operated by a motor (not shown) activated by the controller 164 (FIG. 1) to pressurize fluid flowing through the compressor head 224 from the inlet passage 208 to the outlet passage 216. The pistons in the compressor head 224 are not completely sealed from the compressor case 220, and therefore fluid leaks from the high-pressure side of the pistons into the compressor case, as shown by arrow 232.

The check valve 228 is positioned in a return passage 236, which fluidly connects the compressor case 220 to the inlet passage 208. In one embodiment, the check valve 228 and return passage 236 are located outside the compressor 140, while in other embodiments one or both of the check valve 228 and the return passage 236 are integral with the compressor 140. The check valve 228 is configured to block fluid flow through the return passage 236 when the pressure of the fluid in the compressor case is less than a predetermined threshold pressure. In one embodiment, the predetermined threshold pressure is measured as a difference between the pressure in the compressor case 220 and the inlet passage 208, while in other embodiments the predetermined threshold pressure is an absolute pressure value that is not dependent on the pressure in the inlet passage 208. In one embodiment, the check valve 228 is configured to open the return passage 236 only when the pressure in the compressor case 220 is greater than the pressure in the inlet passage 208 by 300 psi. While the illustrated embodiment shows the return passage connecting the compressor case 220 to the inlet passage 208, in other embodiments the return passage connects the compressor case 220 directly to the compressor head 224 via the check valve 228.

FIG. 2A illustrates the compressor system 200 at the beginning of a recovery operation. The low-side inlet valve 204 and the high-side outlet valve 212 are opened, and refrigerant flows from the source, for example an air conditioning system (not shown), to the compressor 140 through the low-side inlet passage 208 and manifold 144. The compressor 140A is activated, and the compressor head 224 pressurizes the refrigerant, forcing the refrigerant through the high-side outlet passage 216, the manifold block 144, and the outlet valve 212.

When the recovery operation begins, there is a minimal amount of refrigerant in the compressor case 220, and the compressor case 220 is therefore at a negligible pressure. Since the pressure in the compressor case 220 is negligible, the check valve 228 is closed, blocking flow through the return passage 236. While the compressor 140 is active, refrigerant flows from the low-side inlet passage 208 through the pistons of the compressor head 224 to the high-side outlet passage 216. Some of the refrigerant flowing through the pistons of the compressor head 224 leaks into the compressor case 220, increasing the pressure in the compressor case 220. Continued operation of the compressor results in the configuration shown in FIG. 2B.

In FIG. 2B, the leakage of the pistons of the compressor head 224 continues to transfer refrigerant into the compressor case 220, increasing the pressure in the compressor case 220. The pressure in the compressor case 220 acts on the pistons in the direction of the compression stroke, reducing the pressure differential between the high-pressure side of the pistons and the case side of the pistons. As a result, the power required for the compression stroke is reduced and the efficiency of the compressor 140 is increased. In the view of FIG. 2B, the pressure difference between the compressor case 220 and the inlet passage 208 has not yet reached the predetermined cracking pressure of the check valve 228, and the check valve 228 remains closed to block flow through the return passage 236.

Once the difference in pressure between the compressor case 220 and the low-side inlet passage 208 exceeds the predetermined threshold pressure, the check valve 228 opens, as illustrated in FIG. 2C. Since the pressure in the compressor case 220 is greater than the pressure in the return passage 236 and the low-side inlet passage 208, the open check valve 228 enables refrigerant to flow from the compressor case 220, through the return passage 236, and back into the inlet passage 208.

The check valve 228 is configured to open before the pressure in the compressor case 220 reaches a pressure that could be dangerous, thereby preventing an unsafe accumulation of pressure in the compressor case 220. Furthermore, the check valve 228 is configured such that at the end of the recovery operation, when the compressor 140 in the recovery unit 100 reduces the pressure in the low-side inlet passage 208 to a near vacuum, the check valve 228 remains closed. The return passage 236 therefore does not allow pressure to leak into or out from the compressor case, and does not disrupt the ability of the compressor 140 to generate a vacuum in the inlet passage 208 and the A/C system. In some embodiments where the predetermined threshold pressure is based on the difference between the pressure in the compressor case 220 and the inlet passage 208, some or all of the pressure may be cleared from the compressor case 220 through the check valve 228 before the vacuum is generated in the low-side inlet passage 208.

Figure 3C:
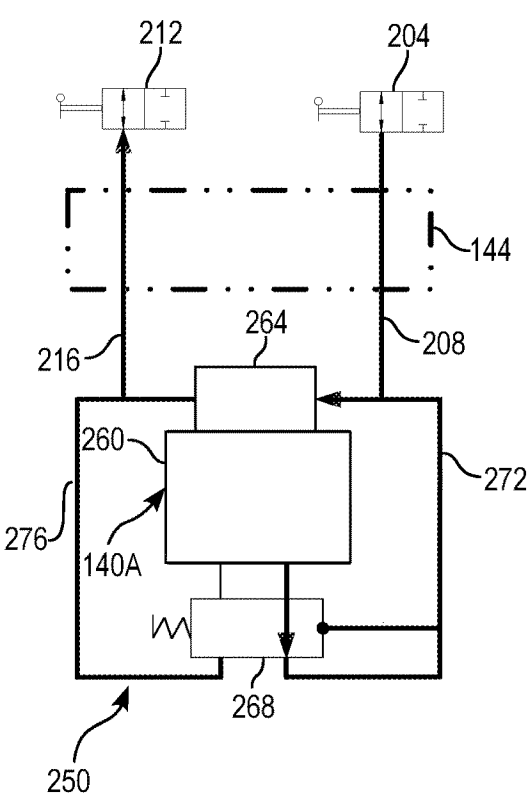
FIG. 3C is a schematic diagram of the compressor of FIG. 3A when the pressure at the low-side of the mechanical valve is below a lower threshold and the low-side of the mechanical valve is open.
Figure 3B:
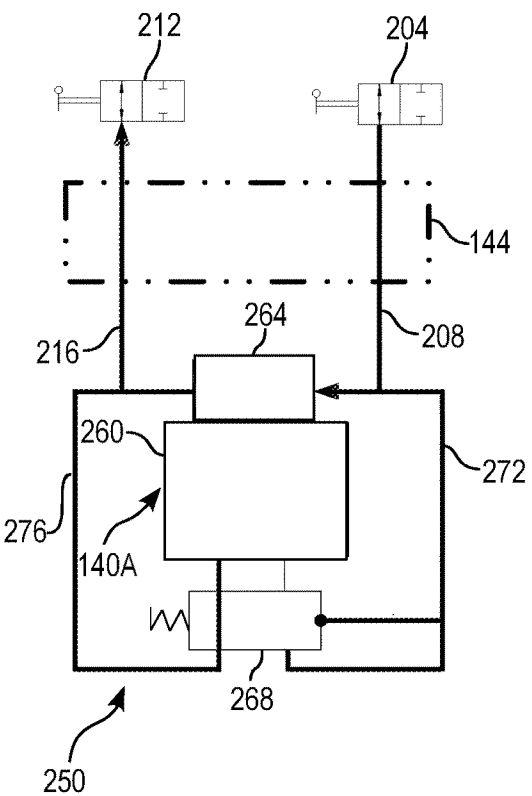
FIG. 3B is a schematic diagram of the compressor of FIG. 3A during the recovery operation with the high-side of the valve open and the low-side closed.
Figure 3A:
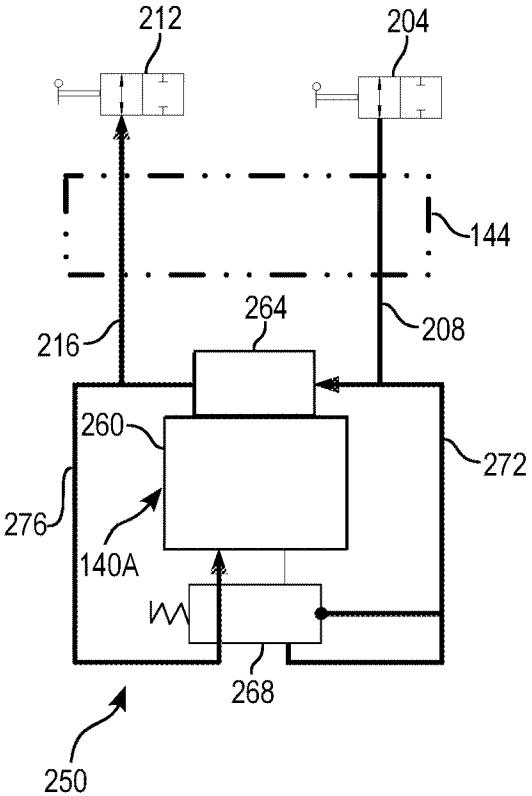
FIG. 3A is a schematic diagram of another compressor having a mechanical valve configured to control pressure in the compressor case, depicted at the beginning of a recovery operation with the high-side of the valve open and the low-side closed.

FIGS. 3A-3C illustrate a simplified schematic view of another compressor system 250 and compressor 140A, which can be used in place of the compressor 140 in the refrigerant recovery system 100 described above. In this embodiment, the compressor system 250 includes the compressor 140A, a low-side inlet valve 204, a low-side inlet passage 208, a high-side outlet valve 212, a high-side outlet passage 216, and a mechanical valve 268 configured to selectively block flow through a low-side return passage 272 and a high-side return passage 276. The inlet valve 204 is configured to regulate flow coming into the compressor 140A. In one embodiment, the inlet valve 204 is connected to the inlet fitting 122 (FIG. 1), while in other embodiments the inlet valve is fluidly connected to a refrigerant storage tank. The low-side inlet passage 208 connects the low-side inlet valve 204, through the manifold block 144, to the compressor 140A. The high pressure side of the compressor 140A is connected through the manifold 144 to the high-side outlet valve 212 by a high-side outlet passage 216. The outlet valve 212 is connected to the outlet fitting 124 (FIG. 1) or to the refrigerant storage tank of the refrigerant service system 100.

The compressor 140A includes a compressor case 260 and a compressor head 264. The compressor case 260 is sealed from atmosphere to prevent egress of gas inside the compressor case 260. The compressor head 264 includes one or more compressor pistons (not shown), which are operated by a motor (not shown) activated by the controller 164 (FIG. 1) to pressurize fluid flowing through the compressor head 264 from the low-side inlet passage 208 to the high-side outlet passage 216.

The low-side return passage 272 connects the compressor case 260 with the low-side inlet passage 208 and the high-side return passage 276 connects the high-side outlet passage 216 with the compressor case 260. The mechanical valve 268 is positioned in the return passages 272, 276 and is configured to selectively block fluid flow through the low-side return passage 272 based on the pressure in the low-side inlet passage 208, and to selectively block fluid flow through the high-side return passage 276 based the pressure in the compressor case 260 or the pressure difference between the high-side outlet passage 216 and the compressor case 260. In one embodiment, the mechanical valve 268 is configured to close the low pressure side when the pressure in the low-side passage 208 is greater a lower threshold, which is 10 psi absolute in one embodiment. In the illustrated embodiment, a single mechanical valve 268 is used to selectively block fluid flow through both the low-side and high-side inlet passages 272, 276. In other embodiments, two independent mechanical valves selectively block the return flow through the passages 272, 276, with one of the mechanical valves in each of the return passages 272, 276. In some such embodiments, a check valve is positioned in each return passage 272, 276. While the illustrated embodiment shows the low-side and high-side return passages 272, 276 connecting the compressor case 260 to the inlet and outlet passages 208, 216, respectively, in other embodiments one or both of the return passages 272, 276 connect the compressor case 260 directly to the corresponding side of the compressor head 264 via the mechanical valve 268.

FIG. 3A illustrates the compressor system 250 at the beginning of a recovery operation. The inlet and outlet valves 204, 212 are opened, and refrigerant flows from the source, for example a vehicle air conditioning system (not shown), to the compressor 140A through the low-side inlet passage 208 and manifold 144. The compressor 140A is activated, and the compressor head 264 pressurizes the refrigerant, forcing the refrigerant through the high-side outlet passage 216 and manifold block 144 and from the outlet valve 212.

When the recovery operation begins, the inlet valve 204 is opened, releasing the pressure within the connected A/C system into the low-side inlet passage 208 and low-side return passage 272. When the pressure in the low-side return passage 272 reaches the lower valve threshold the mechanical valve 268 closes the low-side return passage 272. The mechanical valve 268 is further configured such that, at low pressures in the compressor case 260, the high-side of the mechanical valve 268 opens, enabling flow from the high-side outlet passage 216 to the compressor case 260, increasing the pressure in the compressor case 260. The mechanical valve 268 is further configured such that, at a high pressure in the inlet passage 208, the low-side of the mechanical valve 268 is closed, blocking flow through the low-side return passage 272, as shown in FIG. 3B.

The compressor head 264 continues to transfer refrigerant into the compressor case 260, via the high-side return passage 276, until the pressure in the compressor case 260 is equal to the pressure in the high-side outlet 216. In some embodiments, the mechanical valve 268 is configured to close at a predetermined pressure in the compressor case 260, such that the pressure in the compressor case 260 is less than the pressure in the high-side outlet passage 216. The pressure in the compressor case 260 acts on the pistons of the compressor head 264 in the direction of the compression stroke, reducing the pressure differential between the high-pressure side of the pistons and the case side of the pistons. As a result, the power required for the compression stroke is reduced and the efficiency of the compressor 140A is improved. In the view of FIG. 3B, the pressure in the inlet passage 208 and low-side return passage 272 remains above the opening pressure of the low-side of the mechanical valve 268, and the low-side of the mechanical valve 268 therefore remains closed to block flow through the low-side return passage 272.

As the recovery cycle continues, the pressure in A/C system to which the compressor system 250 is connected decreases as the refrigerant in the A/C system depletes, and the pressure in the inlet passage 208 and the low-side return passage 272 also decreases. When the pressure in the inlet passage 208 and the low-side return passage 272 decreases below a lower threshold, the low-side of the mechanical valve 268 opens, allowing the pressurized refrigerant in the compressor case 260 to escape into the low-side return passage 272 and inlet passage 208, as shown in FIG. 3C. In one embodiment, the low-side of the mechanical valve 268 is configured to open when the pressure on the low-side inlet passage 208 drops below 10 psi. As a result of the low-side of the mechanical valve 268 opening, refrigerant flows out of the compressor case 260 through the mechanical valve 268 and the low-side return passage 272, back into the inlet passage 208, and through the compressor head 264. Therefore, the refrigerant is drained from the compressor case 260 and fed through to the outlet passage 216, enabling recovery of a greater amount of the refrigerant from the source.

Figure 4C:
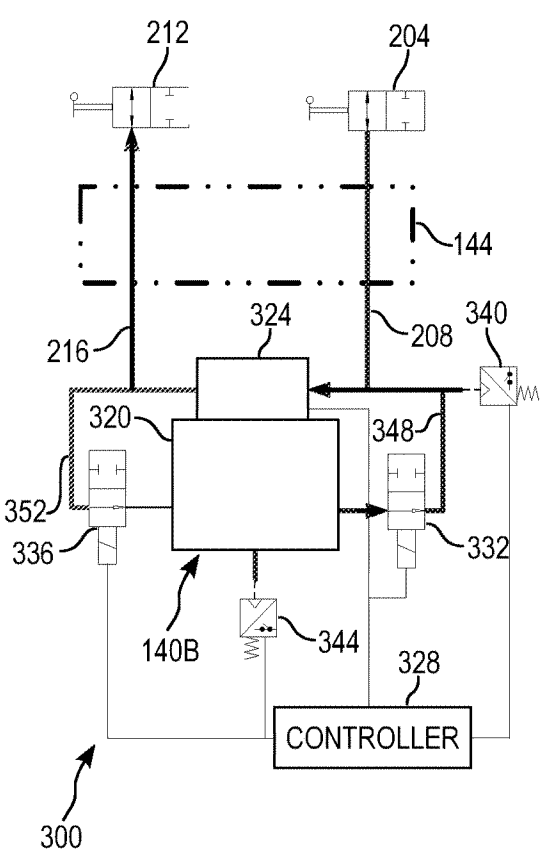
FIG. 4C is a schematic diagram of the compressor of FIG. 4A when the pressure in the low-side of the compressor is below the lower threshold and the high-side valve is closed and the low-side valve is open.
Figure 4B:
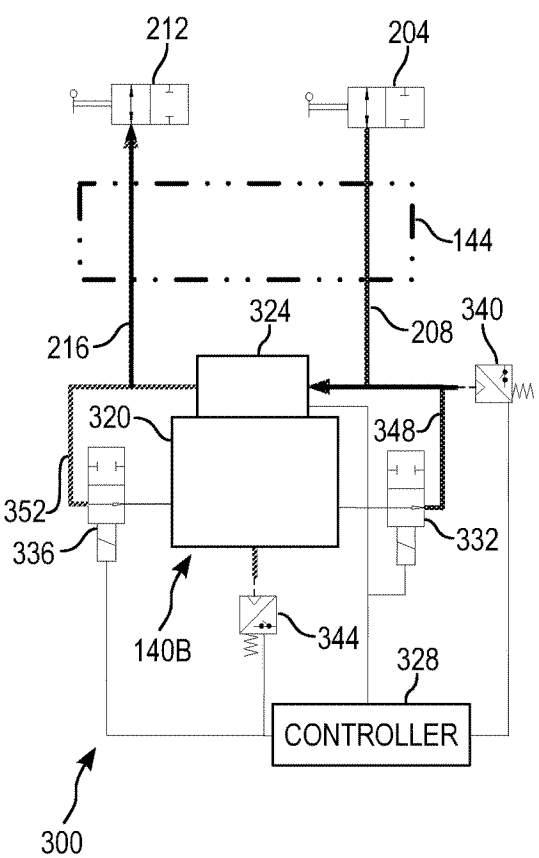
FIG. 4B is a schematic diagram of the compressor of FIG. 4A when the pressure in the compressor case reaches a maximum and both the low-side and high-side valves are closed.
Figure 4A:
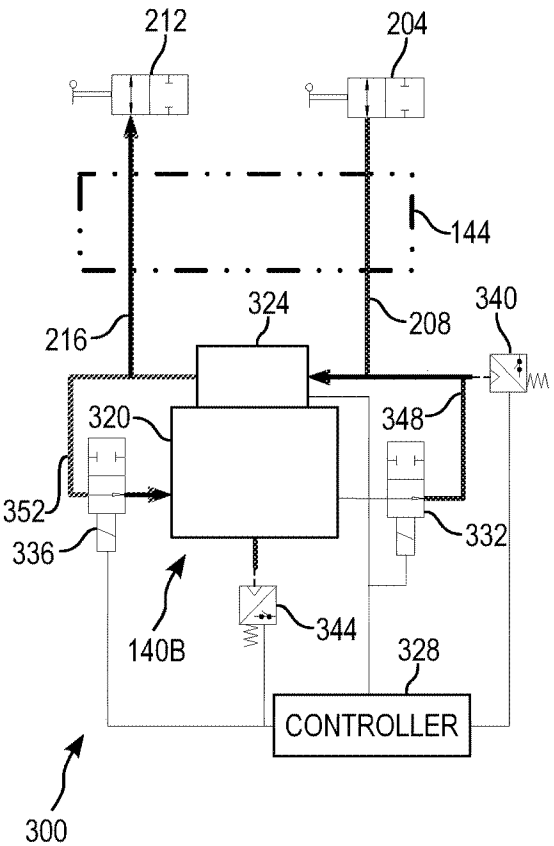
FIG. 4A is a schematic diagram of yet another compressor having solenoid valves configured to control pressure in the compressor case, depicted during a recovery operation with the high-solenoid valve open and the low-side solenoid valve closed.

FIGS. 4A-4C illustrate a simplified schematic view of another compressor system 300 and compressor 140B for the refrigerant recovery system 100 discussed above with reference to FIG. 1. An inlet valve 204 connects to the inlet fitting 122 (FIG. 1) to regulate flow into the compressor 140B. A low-side inlet passage 208 connects the inlet valve 204, through the manifold block 144, to the compressor 140B. The high pressure side of the compressor is connected through the manifold 144 to outlet valve 212 by high-side outlet passage 216. The outlet valve 212 is connected to the outlet fitting 124 of the refrigerant service system 100.

The compressor system 300 includes the compressor 140B, having a compressor case 320 and a compressor head 324, a controller 328, a low-side solenoid valve 332, a high-side solenoid valve 336, a low-side pressure transducer 340, and a case pressure transducer 344. The compressor case 320 is sealed from atmosphere to prevent egress of gas inside the compressor case 320. The compressor head 324 includes the compressor pistons, which are operated by a motor (not shown) activated by the controller 328 to pressurize fluid flowing through the compressor head 324 from the inlet passage 208 to the outlet passage 216.

The compressor system 300 further includes a low-side return passage 348 connecting the compressor case 320 with the low-side inlet passage 208 and a high-side return passage 352 connecting the high-side outlet passage 216 with the compressor case 320. The low-side solenoid valve 332 is positioned in the low-side return passage 348 and is configured to selectively block flow through the low-side return passage 348 between the compressor case 320 and the low-side inlet passage 208. The high-side solenoid valve 336 is positioned in the high-side return passage 352, and is configured to selectively block fluid flow through the high-side return passage 352. While the illustrated embodiment shows the low-side and high-side return passages 348, 352 connect the compressor case 320 to the inlet and outlet passages 208, 216, respectively, in other embodiments one or both of the return passages 348, 352 connect the compressor case 320 directly to the corresponding side of the compressor head 324 via the solenoid valves 332, 336. In some embodiments, the return passages 348, 352 and solenoid valves 332, 336 are integrated with the compressor 140B, while in other embodiments one or more of the return passages 348, 352 and the solenoid valves 332, 336 are located external to the compressor 140B.

The low-side pressure transducer 340 is positioned in the low-side return passage 348 and is configured to sense the pressure in the low-side return passage 348. In some embodiments, the low-side pressure transducer is instead located in the low-side inlet passage 208. The case pressure transducer 344 is connected to the compressor case 320 and is configured to sense the pressure in the compressor case 320. In some embodiments, the case pressure transducer 344 is positioned within the compressor case 320. The pressure transducers 340, 344 are configured to transmit an electronic signal representing the pressure in the low-side return passage 348 and the compressor case 320, respectively, to the compressor controller 328.

The compressor controller 328 is operatively connected to the solenoid valves 332, 336, the pressure transducers 340, 344, and the motor of the compressor 140B. The controller is configured to transmit electronic signals to operate the solenoid valves 332, 336 and the compressor motor, and to receive the electronic signals transmitted by the pressure transducers 340, 344 representing the pressure in the low-side passage 208 and compressor case 320, respectively.

Operation and control of the various components, including solenoid valves 332, 336 and the compressor pistons, and functions of the compressor system 300 are performed with the aid of the compressor controller 328. The compressor controller 328 is implemented with general or specialized programmable processors that execute programmed instructions. The instructions and data required to perform the programmed functions are stored in a memory unit associated with the compressor controller 328. The processors, memory, and interface circuitry configure the compressor controller 328 to perform the functions described above and the processes described below. These components are provided on a printed circuit board or as a circuit in an application specific integrated circuit (ASIC). Each of the circuits can be implemented with a separate processor or multiple circuits can be implemented on the same processor.

Alternatively, the circuits can be implemented with discrete components or circuits provided in VLSI circuits. Also, the circuits described herein can be implemented with a combination of processors, ASICs, discrete components, or VLSI circuits. In some embodiments, the compressor controller 328 is partially or completely separate from the controller 164 of the refrigerant service system 100, while in other embodiments the controller 164 is configured to perform the functions of the compressor controller 328, and no independent compressor controller 328 is necessary.

Figure 5:
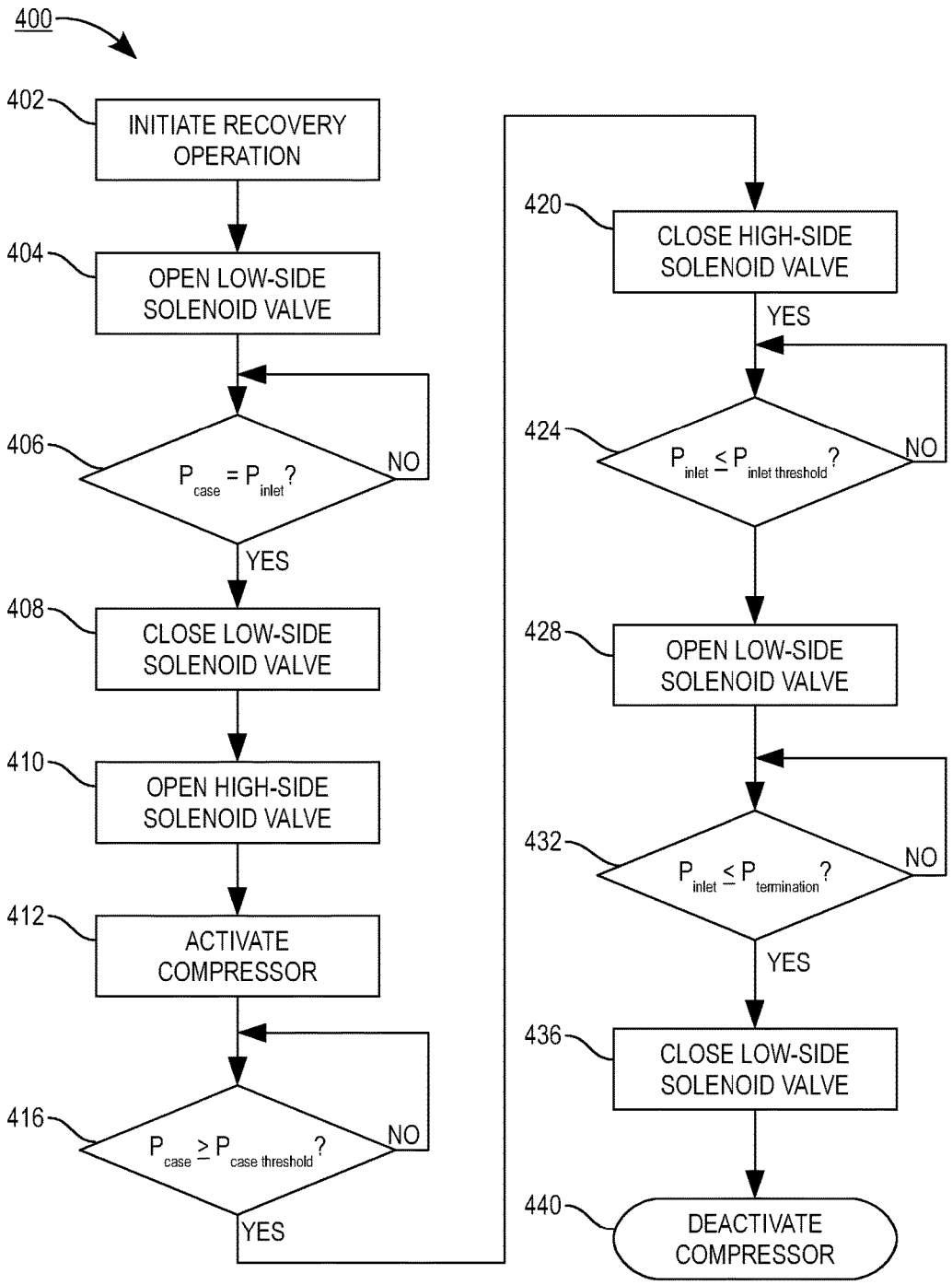
FIG. 5 is a process diagram of a method of operating a compressor such as the compressor of FIGS. 4A-4C during a recovery operation.

FIG. 5 illustrates a flow diagram for a process 400 of operating a compressor to control the pressure in the compressor case. The process 400 is described with reference to the refrigerant recovery system 100 of FIG. 1 and the compressor 140B of FIGS. 4A-4C, though the reader should appreciate that the process 400 is not limited to use in the embodiment described above. The processor of the compressor controller 328 is configured to execute programmed instructions stored in a memory to operate the components of the compressor system 300 to implement the method 400.

The process 400 begins with the initiation of a recovery operation (block 402). The recovery operation is initiated by a user of the refrigerant recovery system 100 after the inlet and outlet fittings 122, 124 are connected to an air conditioning system (not shown). The inlet and outlet vales 204, 212 are opened, fluidly connecting the compressor 140B to the air conditioning system being serviced. Refrigerant under pressure from the air conditioning system flows through the low-side inlet passage 208 to the compressor 140B.

The controller 328 opens the low-side solenoid valve 332 (block 404) to allow refrigerant from the air conditioning system to enter the compressor case 320. The refrigerant in the air conditioning system has a pressure greater than atmosphere. As a result, opening the low-side solenoid valve 332 shortly after initiation of the recovery operation increases the pressure in the compressor case 320. The controller 328 operates the case pressure transducer 344 and the inlet pressure transducer 340 to sense the pressure in the case 320 and the inlet, respectively, and compares the case pressure with the inlet pressure (block 406). In some embodiments, the controller does not perform the comparison between the case pressure and the inlet pressure, instead delaying a predetermined time to allow the pressure in the case 320 to increase to the initial inlet pressure. Once the case pressure reaches the inlet pressure, the controller 328 operates the low-side solenoid valve 332 to close in order to trap the initial inlet pressure in the compressor case 320 (block 408). In some embodiments, the process omits blocks 404, 406, and 408, instead proceeding directly from block 402 to block 412.

The controller 328 opens the high-side solenoid valve 336 (block 410) and activates the compressor 140B (block 412). In some embodiments, the high-side solenoid valve 336 is opened at the same time as the compressor 140B is activated, while in other embodiments the high-side solenoid valve 336 is opened before or after activating the compressor 140B. FIG. 4A illustrates the compressor system 300 after the compressor 140B is activated and the high-side solenoid valve 336 is open. The compressor head 324 pressurizes the refrigerant flowing through the compressor 140B to the high-side outlet passage 216. Since the high-side solenoid valve 336 is open, some of the pressurized refrigerant flows from the high-side outlet passage 216 into the compressor case 320 through the high-side return passage 352.

The controller 328 then operates the case pressure transducer 344 to sense the pressure in the case 320, and compares the sensed case pressure with a predetermined threshold case pressure (block 416). As long as the pressure in the case remains below the predetermined threshold case pressure, the controller 328 repeats block 416, operating the case pressure transducer 344 to sense the case pressure and comparing the case pressure to the threshold pressure. In one embodiment, the threshold case pressure is 500 psi, though the threshold case pressure is different in other embodiments. Once the case pressure is equal to or greater than the case pressure threshold, the controller 328 operates the high-side solenoid valve 336 to close, (block 420), as shown in FIG. 4B, to retain the pressure in the case at the threshold. The recovery operation continues, and the pressure trapped in the compressor case 320 exerts a force assisting the compressor pistons in the compression stroke and reducing the pressure differential between the high-pressure side of the pistons and the case side of the pistons. The compressor 140B therefore requires less energy to compress the refrigerant flowing through the compressor head 324, and the efficiency of the compressor 140B is greater than a compressor having an unpressurized case.

As the recovery operation continues, the amount of refrigerant in the air conditioning system depletes, and as a result the pressure in the low-side inlet passage 208 decreases. The controller 328 is configured to operate the inlet pressure transducer 340 to sense the pressure in the low-side inlet passage 208 or the low-side return passage 348. The sensed inlet pressure is compared to an inlet pressure threshold stored in memory (block 424), and the controller 328 continues operating the inlet pressure transducer 340 to sense the pressure until the pressure in the inlet drops to the inlet pressure threshold. In one embodiment, the inlet pressure threshold is 10 psi, though the inlet pressure threshold is different in other embodiments.

Once the inlet pressure is less than or equal to the inlet pressure threshold, the controller 328 ensures that the high-side solenoid valve 336 is closed and opens the low-side solenoid valve 332 (block 428), as shown in FIG. 4C, releasing the refrigerant trapped in the compressor case 320 through the low-side return passage 348. The refrigerant then passes through the compressor head 324 and out the high-side outlet passage 216. The controller 328 continues operating the inlet pressure transducer 340 to sense the pressure in the inlet, comparing the sensed pressure with a predetermined termination pressure stored in memory (block 432). In some embodiments, the termination pressure is equal to the inlet pressure threshold, while in other embodiments the termination pressure is less than or greater than the inlet pressure threshold. In some embodiments, the termination pressure is near vacuum, enabling the system to recover nearly all the refrigerant from the air conditioning system.

Once the inlet pressure is less than or equal to the termination pressure, the controller operates the low-side solenoid valve 332 to close (block 436) and deactivates the compressor 140B (block 440). In some embodiments, the low-side solenoid valve 332 is closed (block 436) and the compressor 140B is deactivated (block 440) simultaneously, while in other embodiments the valve 332 is closed (block 436) before or after the compressor 140B is deactivated (block 440). Once the low-side solenoid valve 332 is closed and the compressor 140B is deactivated, the recovery operation is complete.

Figure 6C:
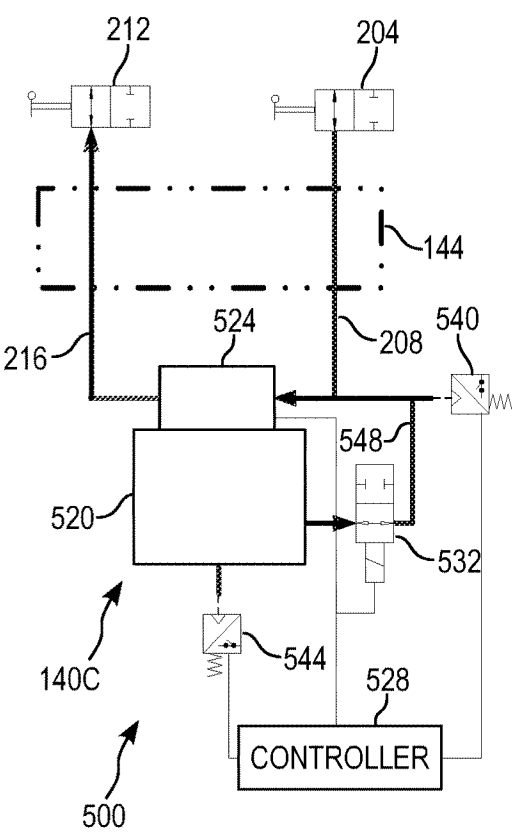
FIG. 6C is a schematic diagram of the compressor of FIG. 6A when the pressure at the inlet of the compressor is below the threshold and the solenoid valve is open to vent the compressor case.
Figure 6B:
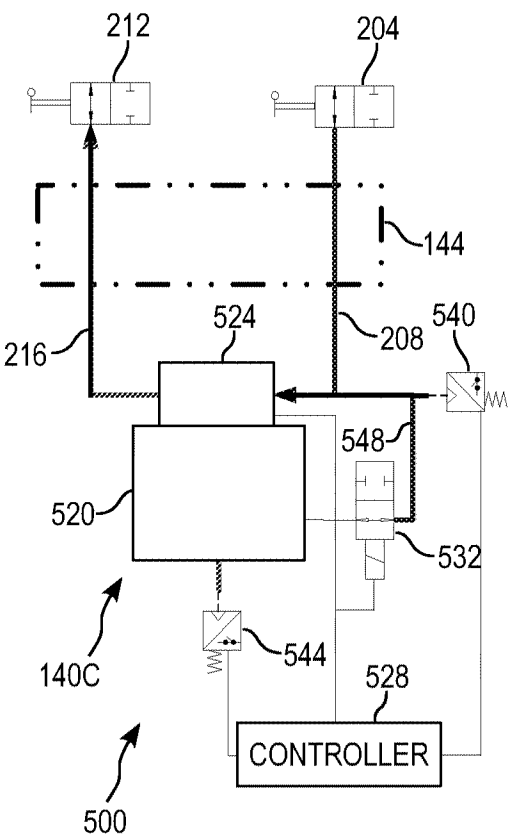
FIG. 6B is a schematic diagram of the compressor of FIG. 6A when the pressure in the compressor case reaches the low-side pressure and the solenoid valve is closed.
Figure 6A:
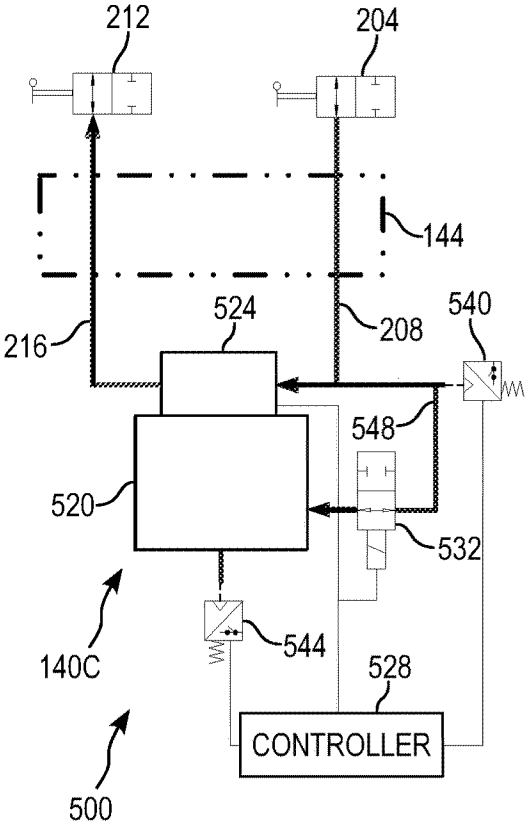
FIG. 6A is a schematic diagram of yet another compressor having a solenoid valve configured to control pressure in the compressor case, depicted at the beginning of a recovery operation when the solenoid valve is open to allow pressure from the low-side into the compressor case.

FIGS. 6A-6C illustrate a simplified schematic view of another compressor system 500 having a compressor 140C configured to replace of the compressor 140 in the refrigerant recovery system 100 discussed above with reference to FIG. 1. An inlet valve 204 connects to the inlet fitting 122 (FIG. 1) to regulate flow from the A/C system into the compressor 140C. A low-side inlet passage 208 connects the inlet valve 204, through the manifold block 144, to the compressor 140C. The high pressure side of the compressor is connected through the manifold 144 to an outlet valve 212 by a high-side outlet passage 216. The outlet valve 212 is connected to the outlet fitting 124 of the refrigerant service system 100.

The compressor system 500 includes the compressor 140C, a compressor case 520, a compressor head 524, a controller 528, a low-side solenoid valve 532, a low-side pressure transducer 540, and a case pressure transducer 544. The compressor case 520 is sealed from atmosphere to prevent egress of gas inside the compressor case 520. The compressor head 524 includes one or more compressor pistons, which are operated by a motor activated by the controller 528 to pressurize fluid flowing through the compressor head 524 from the inlet passage 208 to the outlet passage 216.

The compressor system 500 further includes a low-side return passage 548 connecting the compressor case 520 with the low-side inlet passage 208. The low-side solenoid valve 532 is positioned in the low-side return passage 548 and is configured to selectively block flow through the low-side return passage 548 between the compressor case 520 and the low-side inlet passage 208. While the illustrated embodiment shows the low-side return passage 548 connecting the compressor case 520 to the inlet passage 208, in other embodiments the low-side return passage 548 connects the compressor case 520 directly to the corresponding input side of the compressor head 524 via the solenoid valve 532.

The low-side pressure transducer 540 is positioned in the low-side return passage 548 and is configured to sense the pressure in the low-side return passage 548. In some embodiments, the low-side pressure transducer 540 is instead located in the low-side inlet passage 208. The case pressure transducer 544 is connected to the compressor case 520 and is configured to sense the pressure in the compressor case 520. In some embodiments, the case pressure transducer 544 is positioned within the compressor case 520. The pressure transducers 540, 544 are configured to transmit an electronic signal representing the pressure in the low-side return passage 548 and the compressor case 520, respectively, to the compressor controller 528.

The compressor controller 528 is operatively connected to the low-side solenoid valve 532, the pressure transducers 540, 544, and the motor of the compressor 140C. The controller 528 is configured to transmit electronic signals to operate the low-side solenoid valve 532 and the compressor motor, and to receive the electronic signals transmitted by the pressure transducers 540, 544 representing the pressure in the low-side passage 208 and compressor case 520, respectively.

Operation and control of the various components, including the low-side solenoid valve 532 and the pistons of the compressor head 524, and functions of the compressor system 500 are performed with the aid of the compressor controller 528. The compressor controller 528 is implemented with general or specialized programmable processors that execute programmed instructions. The instructions and data required to perform the programmed functions are stored in a memory unit associated with the compressor controller 528. The processors, memory, and interface circuitry configure the compressor controller 528 to perform the functions described above and the processes described below. These components are provided on a printed circuit board or as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. In some embodiments, the compressor controller 528 is partially or completely separate from the controller 164 of the refrigerant service system 100, while in other embodiments the controller 164 is configured to perform the functions of the compressor controller 528, and no independent compressor controller 528 is necessary.

Figure 7:
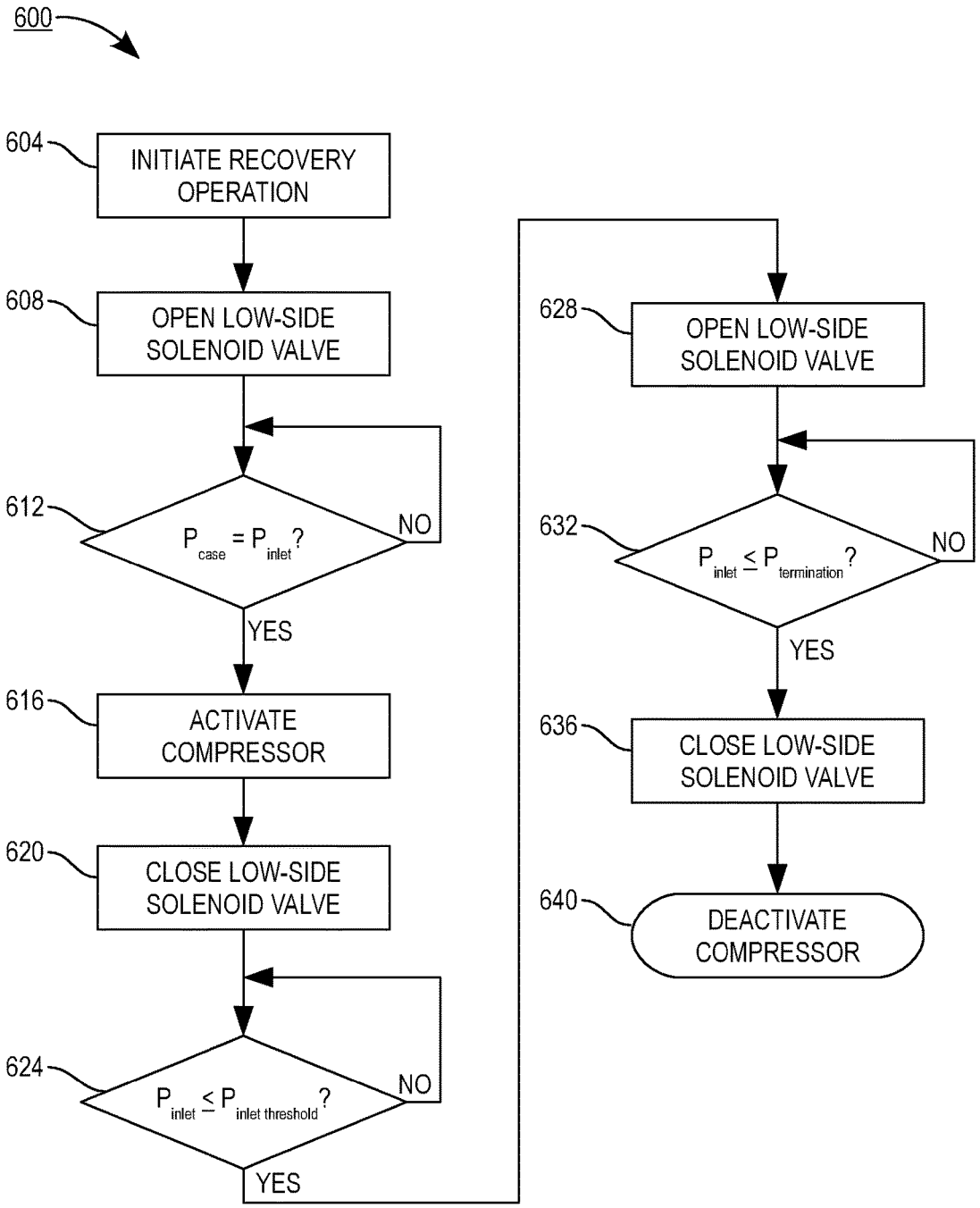
FIG. 7 is a process diagram of a method of operating a compressor such as the compressor of FIGS. 6A-6C during a recovery operation.

FIG. 7 illustrates a flow diagram for a process 600 of operating a compressor to control the pressure in the compressor case. The process 600 is described with reference to the refrigerant recovery system 100 of FIG. 1 and the compressor system 500 of FIGS. 6A-6C, though the reader should appreciate that the process 600 is not limited to use in the embodiment described above. The processor of the compressor controller 528 is configured to execute programmed instructions stored in a memory to operate the components of the compressor system 500 to implement the method 600.

The process 600 begins with the initiation of a recovery operation (block 604). The recovery operation is initiated by a user of the refrigerant recovery system 100 after the fittings 122, 124 are connected to an air conditioning system (not shown). The inlet and outlet vales 204, 212 are opened, fluidly connecting the compressor 140C to the air conditioning system being serviced. Refrigerant under pressure from the air conditioning system flows through the low-side inlet passage 208 to the compressor 140C.

The controller 528 opens the low-side solenoid valve 532 (block 608) to allow refrigerant from the air conditioning system to enter the compressor case 520. The refrigerant in the air conditioning system has a pressure greater than atmosphere. As a result, opening the low-side solenoid valve 532 shortly after initiation of the recovery operation increases the pressure in the compressor case 520. FIG. 6A illustrates the compressor system 500 after the low-side solenoid valve 532 is opened. The controller 528 operates the case pressure transducer 544 and the inlet pressure transducer 540 to sense the pressure in the case 520 and the inlet, respectively, and compares the case pressure with the inlet pressure (block 612). In some embodiments, the controller 528 does not perform the comparison between the case pressure and the inlet pressure, instead delaying a predetermined time to allow the pressure in the case 520 to increase to the initial inlet pressure. In such embodiments, the compressor case 520 need not include a case pressure transducer.

Once the case pressure reaches the inlet pressure, the controller 528 activates the compressor 140C to pressurize the refrigerant and move the refrigerant toward the outlet valve 212 (block 616) and closes the low-side solenoid valve 532 to trap the initial inlet pressure in the compressor case 520 (block 620). In some embodiments, the controller 528 is configured to activate the compressor 140C prior to the case pressure reaching the inlet pressure, while in other embodiments, the compressor 140C is activated simultaneous with or prior to opening the low-side solenoid valve (block 608). In further embodiments, the compressor 140C is not activated (block 616) until after the low-side solenoid valve 532 is closed (block 620). FIG. 6B illustrates the compressor system 500 after activating the compressor 140C and closing the low-side solenoid valve 532.

As the recovery operation continues, the amount of refrigerant in the air conditioning system depletes, and as a result the pressure in the low-side inlet passage 208 decreases. The controller 528 is configured to operate the inlet pressure transducer 540 to sense the pressure in the low-side inlet passage 208 or the low-side return passage 548. The inlet pressure is compared to an inlet pressure threshold stored in memory (block 624), and the controller 528 continues comparing the inlet pressure with the threshold inlet pressure until the pressure in the inlet drops to the inlet pressure threshold. In one embodiment, the inlet pressure threshold is 10 psi, though the inlet pressure threshold is different in other embodiments. In some embodiments, the controller 528 is further configured to monitor the case pressure and open the solenoid valve 532 if the pressure in the case 520 exceeds a safety threshold.

Once the inlet pressure is less than or equal to the inlet pressure threshold, the controller 528 opens the low-side solenoid valve 532 (block 628), as shown in FIG. 6C, releasing the refrigerant trapped in the compressor case 520 through the low-side return passage 548. The refrigerant then passes through the compressor head 524 and out the high-side outlet passage 216. The controller 528 continues operating the inlet pressure transducer 540 to sense the pressure in the inlet, comparing the sensed pressure with a predetermined termination pressure stored in memory (block 632). In some embodiments, the termination pressure is equal to the inlet pressure threshold, while in other embodiments the termination pressure is less than or greater than the inlet pressure threshold. In some embodiments, the termination pressure is near vacuum, enabling the system to recover nearly all the refrigerant from the air conditioning system.

Once the inlet pressure is less than or equal to the termination pressure, the controller operates the low-side solenoid valve 532 to close (block 636) and deactivates the motor of the compressor 140C (block 640). In some embodiments, the low-side solenoid valve 532 is closed (block 636) and the compressor motor is deactivated (block 640) simultaneously, while in other embodiments the valve 532 is closed (block 636) before or after the compressor motor is deactivated (block 640). Once the low-side solenoid valve 532 is closed and the compressor motor is deactivated, the refrigerant recovery operation is complete.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

The invention claimed is:

1. A compressor system for an air conditioning service system, comprising:

a compressor including a compressor case and a compressor head;

an inlet;

an outlet;

a low side passage fluidly connecting the inlet to the compressor head;

a high side passage fluidly connecting the outlet to the compressor head;

a low side return passage fluidly connecting the compressor case with the low side passage;

a high side return passage fluidly connecting the compressor case with the high side passage;

a valve arrangement including a high side portion and a low side portion, the low side portion positioned in the low side return passage and configured to control flow in the low side return passage and the high side portion positioned in the high side return passage and is configured to control flow through the high side return passage; and wherein:

the valve arrangement is configured such that the high side portion opens to connect the compressor case to the high side passage when a first pressure in the compressor case is less than or equal to a first predetermined threshold;

and the valve arrangement is configured such that the high side portion closes to disconnect the compressor case from the high side passage when the first pressure is greater than the first predetermined threshold.

2. The compressor system of claim 1, wherein:

the valve arrangement is configured such that the low side portion closes to disconnect the compressor case from the low side passage when a second pressure in the low side passage is greater than a second predetermined threshold; and the valve arrangement is configured such that the low side portion opens to connect the compressor case to the low side passage when the second pressure is less than or equal to the second predetermined threshold.

3. The A compressor system for an air conditioning service system, comprising:

a compressor including a compressor case and a compressor head;

an inlet;

an outlet;

a low side passage fluidly connecting the inlet to the compressor head;

a high side passage fluidly connecting the outlet to the compressor head;

a low side return passage fluidly connecting the compressor case with the low side passage; and a valve arrangement positioned at least partially in the low side return passage and configured to control flow in the low side return passage, the valve arrangement including a first valve positioned at least partially in the low side return passage and configured to control flow in the low side return passage;

a first pressure sensor configured to generate a first pressure signal corresponding to a first pressure in the low side passage;

a second pressure sensor configured to generate a second pressure signal corresponding to a second pressure in the compressor case; and a controller configured to obtain a first pressure signal from the first pressure sensor and the second pressure signal from the second sensor and to operate the first valve to open and close based upon a pressure difference between the first pressure signal and the second pressure signal.

4. The compressor system of claim 3, wherein the controller is configured to operate the first valve to open upon initiation of a recovery operation, to close upon the first and second pressure signals being equal, and to open upon the first pressure signal being equal to or less than a predetermined threshold.

5. The compressor system of claim 4, further comprising:

a high side return passage fluidly connecting the compressor case with the high side passage, wherein the valve arrangement includes a second valve positioned in the high side return passage and configured to control flow through the high side return passage, and wherein the controller is further configured to open the second valve during operation of the compressor to connect the high side passage to the compressor head and to close the second valve upon the first pressure signal being greater than a case pressure threshold.

6. A method of claim of operating a compressor system of an air conditioning service system, comprising:

moving pressurized fluid into a compressor case;

operating a compressor head to move fluid between a low side passage, which fluidly connects an inlet to a compressor head of the compressor system, and a high side passage, which fluidly connects an outlet to the compressor head;

moving fluid from the compressor case through a valve arrangement located at least partially in a low side return passage to the low side passage after operation of the compressor head, the low side return passage fluidly connecting the compressor case with the low side passage;

sensing a first pressure in the low side passage;

sensing a second pressure in the compressor case;

and operating a first valve of the valve arrangement, which is located at least partially in the low side return passage, to open and close the low side return passage to control flow in the low side return passage, based upon a pressure difference between the first pressure and the second pressure.

7. The method of claim 6, further comprising:

operating the first valve to open upon initiation of a recovery operation;

operating the first valve to close upon the first and second pressures being equal;

and operating the first valve to open upon the first pressure being equal to or less than a predetermined threshold.

8. The compressor system of claim 7, further comprising:

operating a second valve of the valve arrangement, which is positioned in a high side return passage between the compressor case and the high side passage, to connect the high side passage to the compressor head during the operation of the compressor head;

and operating the second valve to close upon the first pressure being greater than a case pressure threshold.

* * * * *